United States Patent [19]

Akesaka et al.

[11] Patent Number: 4,630,869

[45] Date of Patent: Dec. 23, 1986

[54] SHIELD TUNNELING MACHINE

[75] Inventors: Toshio Akesaka, Yokohama; Kenju Suzuki, Mobara; Toshio Sumi, Kodaira, all of Japan

[73] Assignee: Kabushiki Kaisha Iseki Kaihatsu Koki, Tokyo, Japan

[21] Appl. No.: 777,312

[22] Filed: Sep. 18, 1985

[30] Foreign Application Priority Data

Dec. 25, 1984 [JP] Japan ..... 59-271910

[51] Int. Cl.[4] ..... E21D 9/08; E21D 23/03

[52] U.S. Cl. ..... 299/33; 299/56; 299/85; 299/86; 299/71; 299/90; 175/336

[58] Field of Search ..... 299/31, 59, 56, 58, 299/71, 85, 86, 90, 33, 11; 175/381, 383, 336

[56] References Cited

U.S. PATENT DOCUMENTS

| | | | |
|---|---|---|---|
| 2,811,341 | 10/1957 | Robbins | 299/90 |
| 2,837,325 | 6/1958 | Biedess | 299/31 |
| 3,437,380 | 4/1969 | Lawrence | 299/31 |
| 3,511,539 | 5/1970 | Schonfeld | 299/56 |
| 3,917,351 | 11/1975 | Pirrie et al. | 299/85 X |
| 4,311,344 | 1/1982 | Akesaka | 299/33 |

*Primary Examiner*—James A. Leppink
*Assistant Examiner*—Michael A. Goodwin
*Attorney, Agent, or Firm*—Kane, Dalsimer, Kane, Sullivan and Kurucz

[57] ABSTRACT

A shield tunneling machine comprises a tubular shield body, a partition wall provided in the shield body, a rotary shaft supported rotatably by the partition wall and extending longitudinally of the shield body, a cutter head disposed on the front end of the rotary shaft and a mechanism for rotating the cutter head through the rotary shaft. The cutter head comprises a first cutter provided with a plurality of cutter bits and a second cutter provided with a plurality of roller bits. The machine also comprises a mechanism for moving straight forward and backward one of the first and second cutters relative to the other. The machine locates the first cutter more forward than the second cutter for excavating the face of stratum having a soft layer like clay layer with the first cutter and the second cutter more forward than the first cutter for excavating the face of the stratum having a hard layer like bedrock layer with the second cutter.

6 Claims, 3 Drawing Figures

SHIELD TUNNELING MACHINE

BACKGROUND OF THE INVENTION

1. Field of the Invention

This invention relates to a shield tunneling machine for excavating a tunnel and, more particularly, to a shield tunneling machine for excavating a tunnel while excavating the tunnel face with a cutter head provided with two types of bits.

2. Description of the Prior Art

Generally, a shield tunneling machine for excavating a tunnel by use of the pressurized muddy water or clear water while preventing collapse of the tunnel face mounts on a cutter head either a plurality of cutter bits used for excavating a soft layer like clay layer or a plurality of roller bits used for excavating a hard layer like bedrock layer.

However, when the machine provided with said cutter bits excavates the hard layer, the cutter bits are damaged by the tunnel face and when the machine provided with said roller bits excavates the soft layer the efficiency of operation is degraded. Thus, the general machine provided with only one type of bits can excavate only one of soft and hard layers according to the type of bits mounted on the cutter head.

Some excavating machines having the cutter head provided with a plurality of cutter bits and a plurality of roller bits are known. However, in these well-known machines the respective cutter bits and roller bits are fixed to the cutter head so that clay, mud, etc. are attached to the roller bits in excavating the soft layer and thus disadvantageously the roller bits hinder the excavating operation and the cutter bits are damaged in excavating the hard layer.

SUMMARY OF THE INVENTION

An object of the present invention is to provide a shield tunneling machine which can be used to excavate either of soft and hard layers and in which in spite of the provision of the cutter bits and the roller bits the roller bits do not hinder the excavating operation in excavating the soft layer and the cutter bits are not damaged in excavating the hard layer.

The shield tunneling machine according to the present invention comprises a tubular shield body, a partition wall provided in the shield body, a rotary shaft rotatably supported by the partition wall and extending along the axis of said shield body, a cutter head disposed on the front end of the rotary shaft and including a first cutter provided with a plurality of cutter bits and a second cutter provided with a plurality of roller bits, a mechanism for rotating said cutter head through said rotary shaft and a mechanism for moving straight forward and backward one of said first and second cutters relative to the other.

According to the present invention, a mechanism is provided in which the cutter bits and roller bits are mounted respectively on the first and second cutters and one of both cutters is moved straight forward and backward relative to the other, so that one of said cutter bits and roller bits can be projected and the other can be retreated for excavation according to the geology of said face. Thus, the shield tunneling machine can be used for excavating either of the soft and hard layers and the foundation having alternatively the soft and hard layers. Further, the roller bits do not hinder the excavating operation in excavating the soft layer and the cutter bits are not damaged in excavating the hard layer.

The other objects and features of the present invention will become apparent from the following description of preferred embodiments of the invention with reference to the accompanying drawings.

DETAILED DESCRIPTION OF PREFERRED EMBODIMENTS

Figure 1:
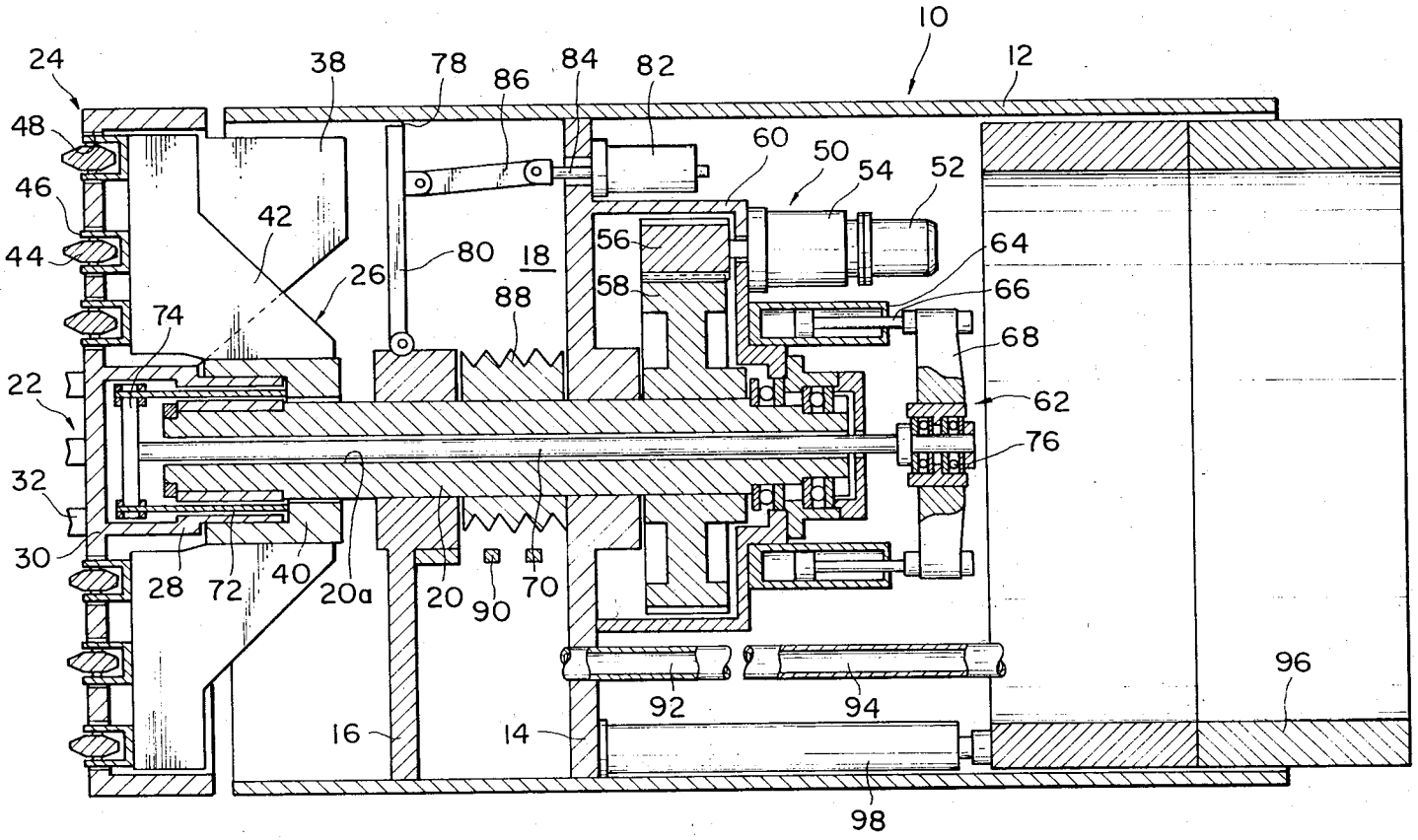
FIG. 1 is a longitudinal sectional view showing an embodiment of a shield tunneling machine according to the present invention.
Figure 2:
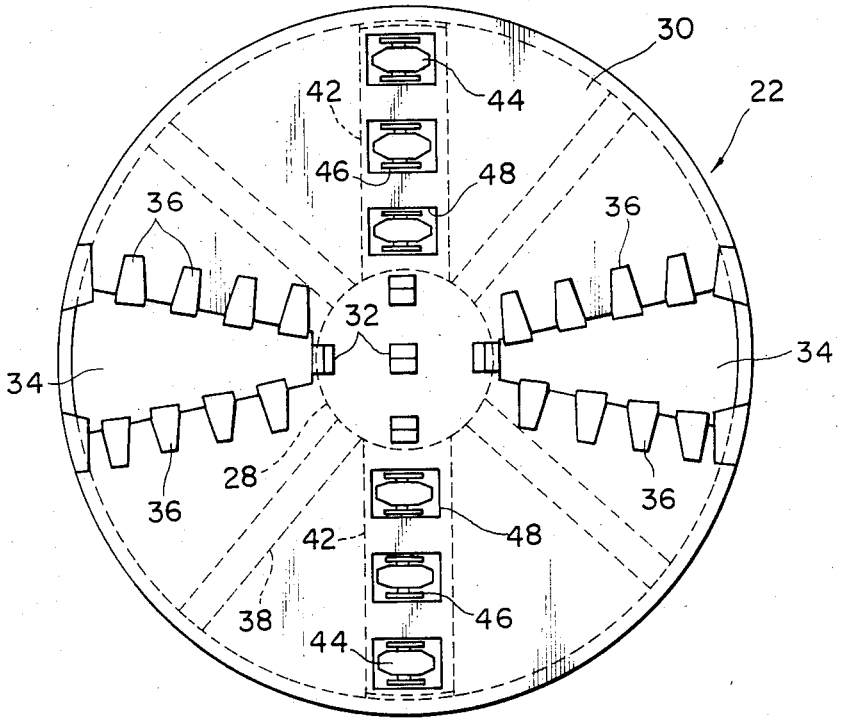
FIG. 2 is a left side view showing said machine shown in FIG. 1.

A shield tunneling machine 10 shown in FIGS. 1 and 2 comprises wall member 14 and partition wall 16 provided in a tubular shield body 12 and crossing same respectively. The wall member 14 is spaced apart rearward from the partition wall 16 to define a muck chamber 18. A hollow rotary shaft 20 extending longitudinally through the center portion of the shield body 12 is rotatably supported by the wall member 14 and the partition wall 16.

A cutter head 22 is disposed on the front end of the rotary shaft 20, and provided with a first cutter 24 and a second cutter 26.

The first cutter 24 comprises a boss 28 fitted onto the front end of the rotary shaft 20 and fixed to same by set screw (not shown) and a circular face plate 30 provided on the front end of the boss 28.

On the center portion of the front surface of the face plate 30 are mounted a plurality of center bits 32. The face plate 30 is provided with a plurality of slits 34 (two shown in an embodiment) extending radially on an outer periphery of said center portion. To both sides opposed to each other of the slit 34 are fixed a plurality of cutter bits 36. To the back of the face plate 30 are fixed a plurality of scrapers 38 (four shown in the embodiment) for scooping muck received in a space between the face plate 30 and the partition wall 16 through the slits 34 as the face plate 30 is rotated. The face plate 30 is also provided between the slits 34 with a plurality of openings lined up radially. The respective openings are referred to window holes 48 for roller bits 44 which will be later described.

The second cutter 26 comprises a boss 40 fitted onto the front end of the rotary shaft 20 and supported movably forward and backward along a slide key (not shown) and a plurality of spokes 42 (two in the shown embodiment) extending radially outward from the boss 40. The respective spokes 42 are disposed behind the face plate 30. A plurality of roller bits 44 are supported rotatably in brackets 46. The respective brackets 46 are disposed on the spoke 42 such that the roller bits 44 can move forward and backward of the face plate 30 through said window holes 48.

The cutter head 22 is rotated by a rotary mechanism 50 disposed in the rear end of the rotary shaft 20. The rotary mechanism 50 comprises a reversible motor 52, a reduction gear 54 connected to the output shaft of the motor, a gear 56 mounted on the output shaft of said gear 54 and a large gear 58 meshing with the gear 56.

The motor 52 and the reduction gear 54 are mounted on a gear case 60 fixed to the wall member 14 by screws (not shown), and the large gear 58 is mounted on the rear end of the rotary shaft 20.

The machine 10 further comprises a straight movement mechanism 62 for moving the second cutter 26 of the cutter head 22 to move straight forward and backward relative to the first cutter 24. The mechanism 62 comprises two pneumatic or hydraulic cylinders 64 mounted on the gear case 60, a connecting arm 68 for interconnecting piston rods 66 of both cylinders 64, a slide shaft 70 disposed in a hollow portion 20*a* extending axially through the rotary shaft 20, a plurality of link rods 72 extending longitudinally through the boss 28 of the first cutter 24 and a link piece 74 for interconnecting the front ends of the respective link rods 72. The rear ends of the respective link rods 72 are connected to the boss 40 of the second cutter 26. The rear end of the slide shaft 70 is rotatably connected to the connecting arm 68 through a plurality of thrust bearings 76 and the front end is connected to the link piece 74.

On the upper portion of the partition wall 16 is formed an opening 78. At the opening 78 is disposed a lid 80 hinged to the partition wall 16. The lid 80 is pivotably connected through an arm 86 to a piston rod 84 of a pneumatic or hydraulic cylinder 82 mounted on the wall member 14 and closes normally the opening 78 by means of the cylinder 82. However, when the pressure of muck received in a space between the partition wall 16 and the cutter head 22 exceeds the pressure set to the cylinder 82, the lid 80 is pivoted to the partition wall 14 against the pressure of the cylinder 82 to open the opening 78 for flowing the muck into the muck chamber 18.

In the muck chamber 18 are disposed a rotor 88 and a stator 90 constituting a crusher for crushing relatively large gravel entering the muck chamber 18. The rotor 88 is mounted on the rotary shaft 20 and the stator 90 below the rotor 88 is mounted on the partition wall 16. High pressure water is sent into said muck chamber 18 through a water supply pipe 92 and the supplied water is discharged from muck chamber 18 to the rear portion of the shield body 12 through a drain pipe 94 together with the muck in the muck chamber 18.

The shield body 12 is advanced by a plurality of hydraulic jacks 98 utilizing segments 96 as reaction bodies. In a space formed between the shield body 12 and the segment 96 by the advance of the shield body 12 is disposed new segments.

In the excavation, the machine 10 transmits the rotation of the motor 52 of the rotary mechanism 50 to the rotary shaft 20 through the reduction gear 54, gear 56 and large gear 58 and further transmits from the rotary shaft 20 to the bosses 28,40 of the first and second cutters 24,26 for rotating the cutter head 22. Thus, said face is excavated by the cutter bits 36 or roller bits 44. The muck enters into said chamber in front of the partition wall 16 through the slits 34 in the face plate 30, flows into the muck chamber 18 through the opening 78 in the partition wall 16 and then are discharged from the muck chamber 18 through the drain pipe 94 together with water.

In operation of the machine 10, when the piston rod 66 in the cylinder 64 of the straight movement mechanism 62 is projected, the slide shaft 70 is moved right as viewed in FIG. 1 relative to the rotary shaft 20 so that the spokes 42 are moved similarly right and spaced apart from the face plate 30 rearward. As a result, the roller bits 44 are retreated rearward of the face plate 30, i.e., behind the cutter bits 36. On the contrary to the above mentioned, when the piston rods 66 retreat into the cylinders 64, the slide shaft 70 is moved left as viewed in FIG. 1 relative to the rotary shaft 20. Thus, the spokes 42 are moved similarly left to approach the face plate 30. As a result, the roller bits 44 are projected forward through the window holes 48 in the face plate 30, i.e., more forward than the cutter bits 36 fixed to the face plate 26.

Thus, the machine 10 can excavate bedrock layers by the roller bits 44 projected more forward than the cutter bits 36 so that the cutter bits 36 can be prevented from being damaged by the bedrock. On the contrary, since the roller bits 44 can be retreated behind the cutter bits 36, the roller bits 44 can be prevented from attachment of clay in excavating said soft layer. Thus, the machine 10 can be used for excavating each of the soft and hard layers and cope with the change in geology only by projecting or retreating the second cutter 26 relative to the first cutter 24 in the boundary of stratum so that when it is used particularly for the stratum having alternatively the soft and hard layers, the efficiency of excavating operation is remarkably improved compared with the shield tunneling machine having the cutter bits and roller bits fixed to the face plate.

Figure 3:
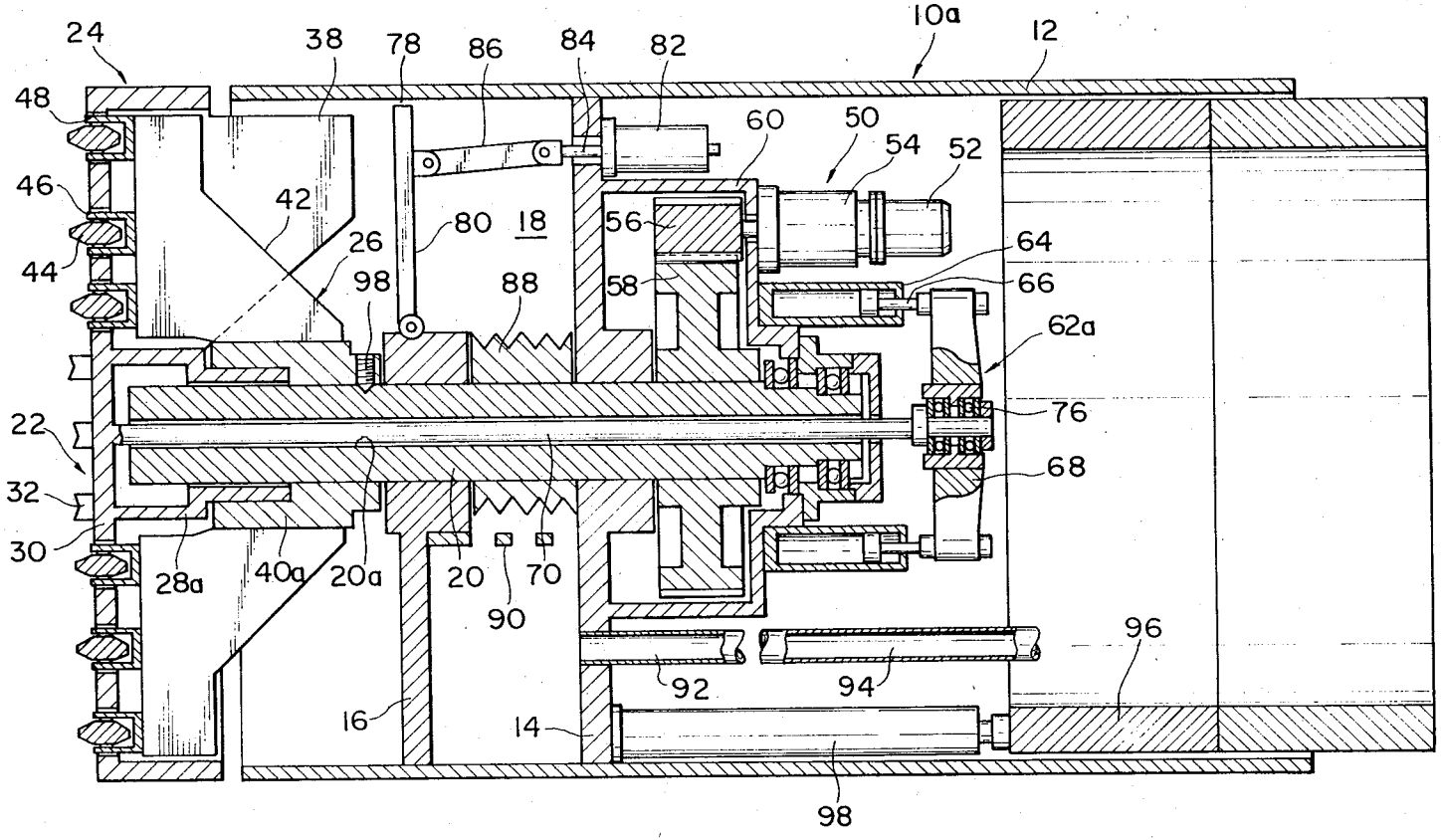
FIG. 3 is a longitudinal sectional view showing a different embodiment of the shield tunneling machine according to the present invention.

A shield tunneling machine 10*a* shown in FIG. 3 is constructed similarly to the machine 10 shown in FIGS. 1 and 2 except for that a boss 28*a* of the first cutter 22 having said cutter bits (not shown) is supported movably forward and backward on the front end of the rotary shaft 20, the face plate 30 is connected directly to the front end of the slide shaft 70 and a boss 40*a* of the second cutter 26 provided with the roller bits 44 is fixed to the rotary shaft 20 by a screw 98. A straight movement mechanism 62*a* in the machine 10*a* is provided with two pneumatic or hydraulic cylinders 64 mounted on the gear case 60, a connecting arm 68 for interconnecting the piston rods 66 in both cylinders 64 and the slide shaft 70 disposed in the hollow portion 20*a* of the rotary shaft 20. The rear end of the slide shaft 70 is rotatably connected to the connecting arm 68 through a plurality of thrust bearings 76 and the front end is connected to the face plate 30.

In operation of the machine 10*a*, when the piston rods 66 in the cylinders 64 of the straight movement mechanism 62 are projected, the cutter bits 36 retreat more than the roller bits 44. On the contrary, when the piston rods 66 in the cylinders 64 are retreated into the cylinders 64, the cutter bits 36 project forward more than the roller bits 44. Thus, since the first cutter 24 advances and retreats relative to the second cutter 26, the machine 10*a* can retreat and project the cutter bits 36 relative to the roller bits 44 in excavating said face of base rock and clay respectively. Therefore, it is possible to use for excavating each of soft and hard layers similarly to the embodiment shown in FIGS. 1 and 2.

What is claimed is:

1. A shield tunneling machine comprising:

a tubular shield body;

a partition wall provided in the shield body;

a rotary shaft supported rotatably by the partition wall and extending along the axis of said shield body;

a cutter head disposed on the front end of the rotary shaft and including a first cutter provided with a plurality of cutter bits for excavating soft layers and a second cutter provided with a plurality of roller bits for excavating hard layers;

a mechanism for rotating said cutter head through said rotary shaft; and a mechanism for moving straight one of said first and second cutters forward and backward relative to the other to place them alternatively between a first position where one is projected more forward than the other and a second position where the said one is retreated more backward than the said other.

2. A shield tunneling machine as claimed in claim 1, wherein said first cutter comprises a boss fitted onto the front end of said rotary shaft and a face plate provided on the front end of the boss and formed with a plurality of slits extending radially, and said cutter bits on the face plate are provided near said slits.

3. A shield tunneling machine as claimed in claim 1, wherein said second cutter comprises a boss fitted onto the front end of said rotary shaft and a plurality of spokes extending radially outward from the boss, and said roller bits are provided on said spokes respectively.

4. A shield tunneling machine as claimed in claim 1, wherein said straight movement mechanism comprises a slide shaft disposed in a hollow portion extending axially through said rotary shaft and a means for sliding the slide shaft forward and backward relative to said rotary shaft.

5. A shield tunneling machine as claimed in claim 1, wherein said first cutter is mounted on the front end of said rotary shaft and said second cutter is supported movably forward and backward on said rotary shaft and connected to said straight movement mechanism.

6. A shield tunneling machine as claimed in claim 1, wherein said first cutter is supported movably forward and backward on said rotary shaft and connected to said straight movement mechanism and said second cutter is mounted on said rotary shaft.

* * * * *